United States Patent [19]

Bellis

[11] 4,211,317

[45] Jul. 8, 1980

[54] COIN CHUTE

[75] Inventor: Robert D. Bellis, Delph near Oldham, England

[73] Assignee: Coin Controls Limited, Royton, England

[21] Appl. No.: 831,854

[22] Filed: Sep. 9, 1977

[30] Foreign Application Priority Data

Oct. 7, 1976 [GB] United Kingdom ..... 41780/76

[51] Int. Cl.[2] ..... G07F 1/02

[52] U.S. Cl. ..... 194/1 D; 194/1 K

[58] Field of Search ..... 194/97 R, 1 E, 1 K, 194/DIG. 7, 1 D, DIG. 29, 79, 80, 76, DIG. 22

[56] References Cited

U.S. PATENT DOCUMENTS

| | | | |
|---|---|---|---|
| 2,008,735 | 7/1935 | Weiler | 194/DIG. 29 |
| 2,752,924 | 7/1956 | Broussard | 194/DIG. 22 |
| 3,243,030 | 3/1966 | Tryon et al. | 194/1 E |

*Primary Examiner*—Stanley H. Tollberg

*Attorney, Agent, or Firm*—Lawrence E. Laubscher

[57] ABSTRACT

The entry slot of a chute by which a coin (or token) is introduced into a coin-released mechanism is formed in a member depressible against a resilient bias to actuate a reject function of a coin-validating mechanism into which the coin is fed.

6 Claims, 5 Drawing Figures

COIN CHUTE

BACKGROUND OF THE INVENTION

1. Field of the Invention

This invention relates to coin chutes for coin released mechanisms. It will be understood that when the term "coin" is used in the following description, it is to be understood as meaning "coin or token".

2. Description of the Prior Art

It is common in coin-released mechanisms to provide an entrance slot of a coin-receiving chute in a metal plate, in which also are provided an aperture receiving a push-button initiating a reject operation of a coin-validating mechanism into which coins pass from the chute and a further aperture at which a rejected coin is presented. The denomination of the coin required to release the mechanism is placed on the plate adjacent the slot. In some cases the slot proper is formed in an exchangeable escutcheon member attached to the metal plate and possibly provided also with a legend denoting the coin denomination.

SUMMARY OF THE INVENTION

It is an object of the invention to provide a coin chute in which the function of coin-receiving slot and reject button are performed by one and the same exchangeable member, thus enabling the number of piece-parts to be reduced.

According to the present invention there is provided a coin-released mechanism coin chute having an entry slot formed in a movable memberdepressible with respect to a body member against a resilient bias and coupled to operate a reject function of a coin validating mechanism into which a coin passes from the chute.

DESCRIPTION OF THE PREFERRED EMBODIMENT

Figure 1:
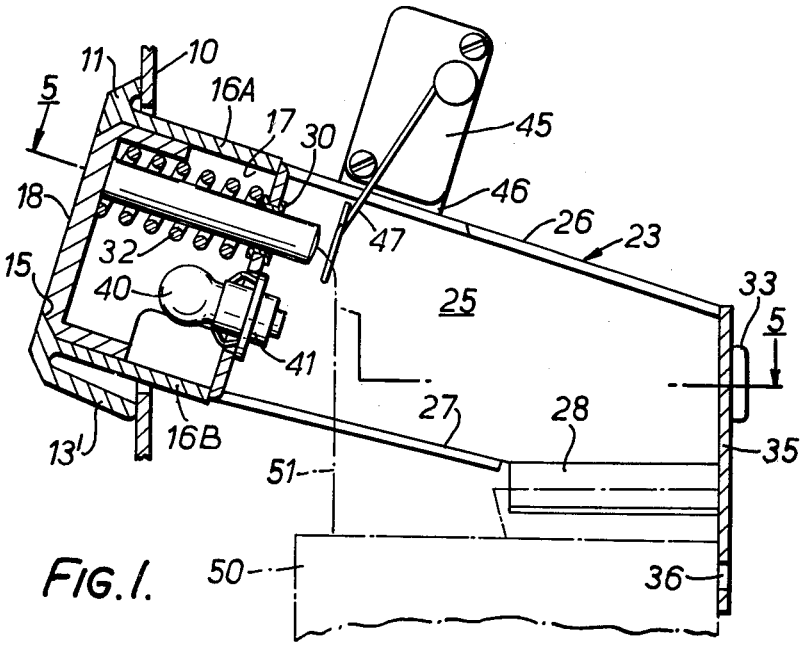
FIG. 1 is a sectional side elevation, taken along the line 1—1 of FIG. 4, of a coin chute embodying the invention.
Figure 2:
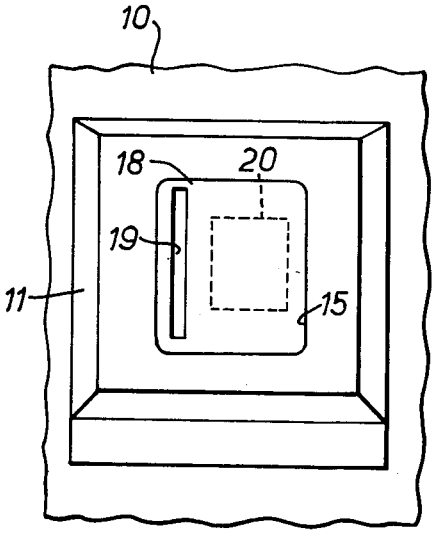
FIG. 2 is a front view.
Figure 3:
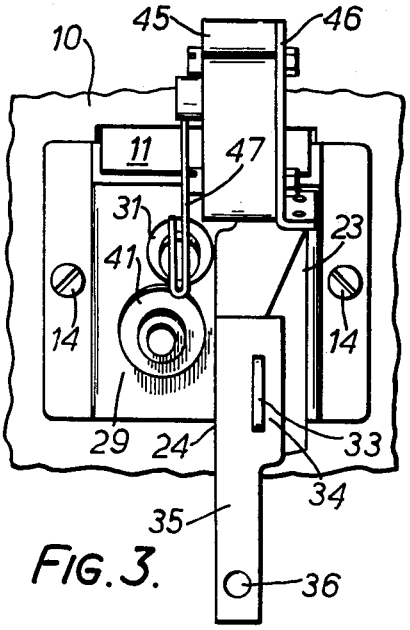
FIG. 3 is a rear view of the chute of FIG. 1.
Figure 4:
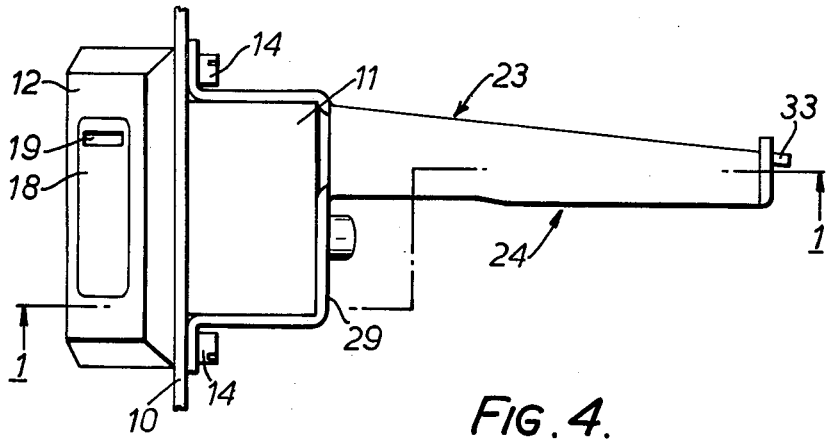
FIG. 4 is a plan view of the chute of FIGS. 1 to 3.
Figure 5:
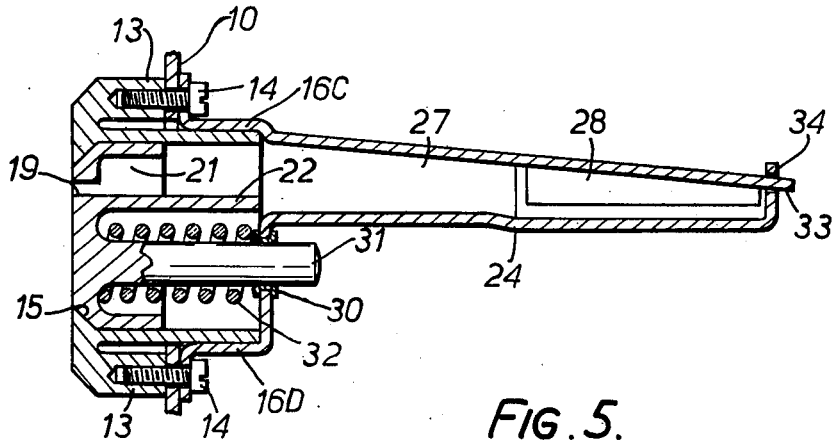
FIG. 5 is a sectional plan view of the chute of FIGS. 1 and 2, taken along line 5—5 of FIG. 1.

The coin chute illustrated by the drawings is mounted in an aperture formed in a metal plate 10 forming a part of the casing of a coin-released mechanism. The part of the chute visible to an operator is one face 12 of a preferably die-cast body member 11. This face is bevelled and is supported at an angle to the metal plate 10 by triangular side webs 13 joined by a bottom web 13'. Side webs 13 are provided with tapped holes in which engage fastening screws 14 passing through holes in sheet 10 adjacent to the aperture in the plate.

Centrally within body member 11 is provided an internally inwardly bevelled aperture 15 behind which extend top and bottom walls 16A, 16B and side walls 16C 16D, forming a rectangular tunnel 17 in which is slidably received a movable coin receiving member 18. The outer face of member 18 is bevelled so that it is located by the internal bevel of body member 11 with the face of member 18 flush with that of member 11.

Member 18 is resiliently biased into this position as later described.

The bottom portion of coin-receiving member 18 which has the form of a five-sided box, is pierced by a coin slot 19 of a size to accept a coin of an appropriate denomination, which will be denoted by a legend formed on member 18 at 20. Preferably sunk lettering is used and movable member 18 may be formed of a black moulded material with the legend in hot-stamped metallic foil lettering.

Alternatively, and as shown, member 18 may be formed of a translucent material and an electric lamp 40 may be arranged to illuminate its inner surface. Lamp 40 is conveniently carried in a holder 41 that is snap-mounted in an aperture in a portion 29 of a sheet-metal chute-forming member 24, later more fully described, that closes a part of the back of body member 11.

A coin inserted into slot 19 is supported on edge at one side firstly by the side wall 21 of member 18 and later by the tunnel wall 17 and at the other side by a rearwardly-extending tongue 22 formed integrally with member 18. From the passage between side walls 16, 22, the coin, rolling on the bottom wall 16B of the tunnel, passes into a chute formed of two sheet-metal members 23, 24 fastened to the assembly by the mounting screws 14. Each of member 23, 24 has a mounting flange lying against the inner surface of metal plate 10 and there extends rearwardly from this flange a portion lying closely against the outer surface of a respective tunnel side wall 16C, 16D. Member 23 is then offset inwardly with respect to tunnel wall 16C so that its inner surface is aligned with that of the tunnel wall. Member 23 has a vertical, rearwardly-extending wall portion 25, from the upper edge of which there extends inwardly of the tunnel a top flange 26 at a right angle to wall 25 as far as that continues the top of the tunnel and from the lower edge of which there extends a first bottom flange 27 at a right angle to wall 25 as far as that continues the bottom 16B of the body tunnel 17, at a reduced inclination to the horizontal. First bottom flange 27 is followed by a second bottom flange 28 that is inclined to wall 25 at an obtuse angle and serves to direct a coin into a validating mechanism 50.

Sheet-metal member 24 has a portion 29 closing the rear of the body member 11 as far as tongue 22. In an aperture in this portion 29 there is inserted a ferrule 30 through which passes a rod 31 extending rearwardly from coin-receiving member 18. Between portion 29 and coin-receiving member 18 and about rod 31 is placed a compression spring 32 that urges member 18 strongly against the internal bevel 15 formed at the front of tunnel 17.

Chute-forming member 23 has at its rear end a projecting tongue 33, that extends through a closelyfitting slot 34 formed in a bent-over end portion 35 of chute-forming member 24, thus securing together the rear ends of members 23, 24. Portion 35 of member 24 may also have, as shown, a downward extension pierced by a hole 36 through which may pass a screw (not shown) to secure the rear of the chute to validating mechanism 50.

If coin-receiving member 18 is urged inwardly of tunnel 18 against the force of spring 32, its rear end actuates by way of a suitable operating linkage denoted only by a broken line 51, a coin rejecting means of a conventional coin-validating mechanism 50, thus returning to the operator a coin which has failed to pass the validation mechanism.

In some applications it will be advantageous to provide an electric switch 45, conveniently a microswitch mounted on the chute assembly, conveniently and as shown by a bracket 46 secured to the top of chute member 23. The actuating arm 47 is arranged to be engaged by member 31 when member 18 is manually depressed. This switch can be used to initiate functions of a vending or gaming machine or reset a pin-table for playing off free games etc. This switch is operated by pushing member 18 which moves linkage 51 away from the plunger of the microswitch. In use, an indication of a time appropriate to operate this microswitch may be indicated by causing electric lamp 40 to repeatedly flash.

What is claimed is:

1. Coin feeding means for feeding a coin to coin-validating means (50) operable to a first condition upon the receipt of a valid coin, said coin-validating means including reject means (51) for ejecting a coin retained in said coin-validating means, comprising (a) a hollow body member (11) adapted for connection adjacent said coin-validating means, said body member including wall portions (16A, 16B) defining a guide tunnel (17);

(b) a coin-receiving member (18) containing a coin entry slot (19) extending longitudinally therethrough, said coin-receiving member being slidably mounted for longitudinal reciprocation in said tunnel; and (c) resilient means (32) biasing said coin-receiving member toward a first position relative to said body member;

(d) said coin-receiving member including a projecting portion (31) for operating said reject means when said coin-receiving member is displaced against the biasing force of said resilient means toward a second position relative to said body member.

2. Coin feeding means for feeding a coin to coin-validating means (50) operable to a first condition upon the receipt of a valid coin, said coin-validating means including reject means (51) for rejecting a coin retained in said coin-validating means, comprising (a) a hollow body member (11) adapted for connection adjacent said coin-validating means, said body including four wall portions defining a guide tunnel portion (17);

(b) a coin-receiving member (18) arranged for longitudinal sliding displacement in said guide tunnel portion, said coin-receiving member consisting of a five-sided parallelpiped box including a bottom wall and four contiguous side walls connected with said bottom wall, said box being arranged with the bottom wall normal to the axis of said tunnel portion; and (c) resilient means (32) biasing said coin-receiving member toward a first position relative to said body member;

(d) said coin-receiving member including a projecting portion (31) for operating said reject means when said coin-receiving member is displaced against the biasing force of said resilient means toward a second position relative to said body member.

3. The improvement as claimed in claim 2, wherein said guide tunnel opens in an outer face of said body member at an aperture bounded by an inwardly bevelled margin portion defining an aperture of smaller cross section that said tunnel, the bottom portion of said movable member being bevelled to fit against said bevelled margin portion with the bottom face of said movable member coplanar with said outer surface of said body member.

4. The improvement of claim 2, wherein said movable member is formed of translucent material, and further including an electric lamp mounted on said body member to illuminate said movable member from within.

5. The improvement of claim 2, and further including electric switch means arranged for actuation by said movable member upon movement thereof toward said second position.

6. The improvement of claim 2 and further including an abutment member mounted on said body member behind said movable member, said movable member projecting portion comprising a pin passing through said abutment member, said resiliemt means comprising a helical compression spring arranged around said pin, abutting against the inner surface of said movable member and against said abutment member, respectively, to provide said resilient bias.

* * * * *